US005086791A

United States Patent [19]

Ferrari

[11] Patent Number: 5,086,791

[45] Date of Patent: Feb. 11, 1992

[54] PROCESS FOR THE PRODUCTION OF A COSMETIC PRODUCT WITH POWDERS OF SEVERAL COLORS OR DIFFERENT CHARACTERISTICS

[75] Inventor: Dario Ferrari, Milan, Italy

[73] Assignee: Intercos Italia S.p.A., Milan, Italy

[21] Appl. No.: 532,605

[22] Filed: Jun. 4, 1990

[30] Foreign Application Priority Data

Nov. 15, 1989 [IT] Italy ..... 22394 A/89

[51] Int. Cl.[5] ..... A45D 24/00

[52] U.S. Cl. ..... 132/200; 132/293; 141/12; 141/80

[58] Field of Search ..... 132/200, 293, 298; 264/113, 118, 119; 141/12, 73, 80

[56] References Cited

U.S. PATENT DOCUMENTS

| | | | |
|---|---|---|---|
| 2,260,456 | 10/1941 | Johnson | 141/80 X |
| 2,573,141 | 10/1951 | Heinrich | 141/80 X |
| 4,660,608 | 4/1987 | Arai | 141/12 |
| 4,817,686 | 4/1989 | Hatakeyama et al. | 141/12 |
| 4,884,601 | 12/1989 | Hatakeyama et al. | 141/12 X |
| 4,887,409 | 12/1989 | Israel et al. | 264/113 X |
| 4,887,410 | 12/1989 | Gandini | 141/12 X |

FOREIGN PATENT DOCUMENTS

| | | | |
|---|---|---|---|
| 0123766 | 11/1984 | European Pat. Off. | 132/293 |
| 0191198 | 8/1986 | European Pat. Off. . | |
| 0300519 | 1/1989 | European Pat. Off. | 141/80 |
| 0328793 | 8/1989 | European Pat. Off. | 141/80 |
| 0044205 | 3/1984 | Japan | 132/293 |
| 0067408 | 4/1985 | Japan | 132/293 |

*Primary Examiner*—John J. Wilson
*Assistant Examiner*—Jeffrey A. Smith
*Attorney, Agent, or Firm*—Eckert Seamans Cherin & Mellott

[57] ABSTRACT

A process for the production of a cosmetic product with powders of several colors or different characteristics includes a succession of alternate stages of introduction of cosmetic powders of different colors or characteristics and compression of the same for the production of a pile of layers of powder, and a further stage of excavation of the pile of layers for the definition of at least one visible surface formed by adjacent portions of said superimposed layers.

4 Claims, 3 Drawing Sheets

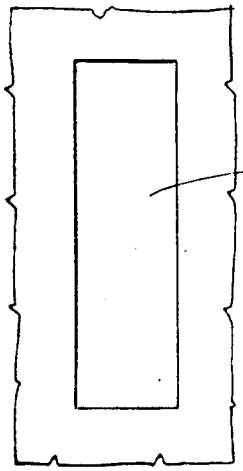
Fig.22
Fig.27
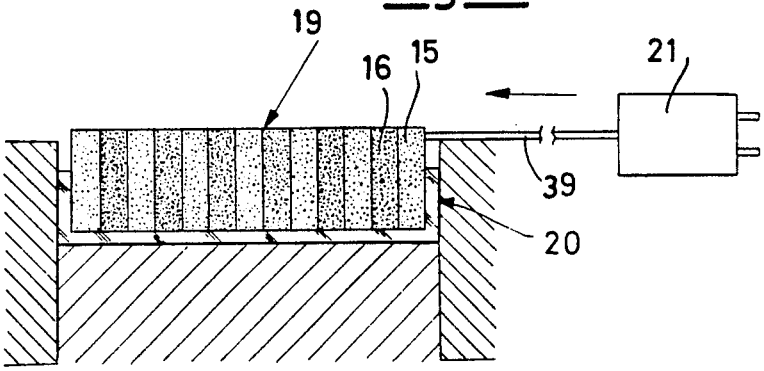
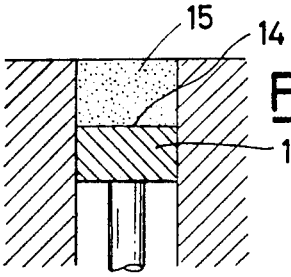
Fig.23
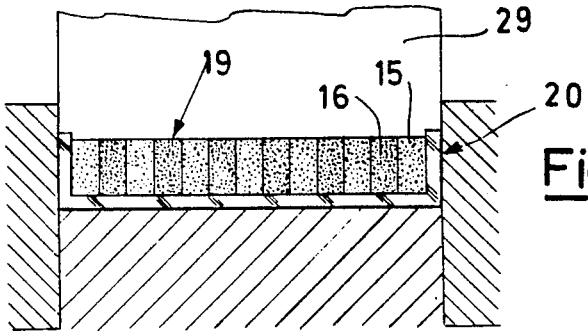
Fig.28
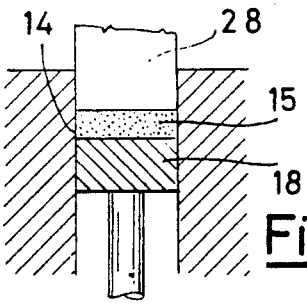
Fig.24
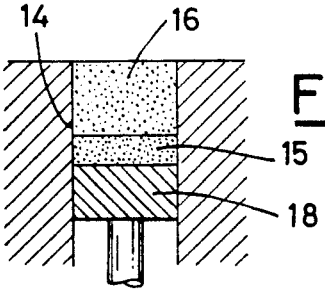
Fig.25
Fig.29
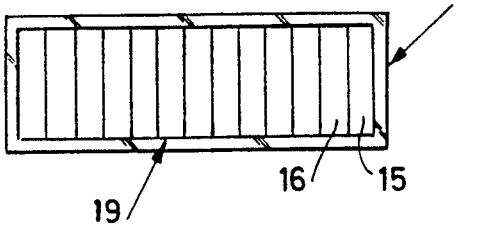
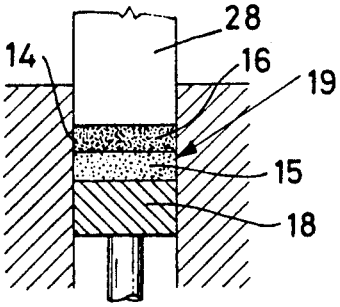
Fig.26

PROCESS FOR THE PRODUCTION OF A COSMETIC PRODUCT WITH POWDERS OF SEVERAL COLORS OR DIFFERENT CHARACTERISTICS

BACKGROUND OF THE INVENTION

1. Field of the Invention

The present invention relates to a process for the production of a cosmetic product with powders of several colors or different characteristics.

2. Prior Art

Cosmetic products of various types, such as face powders, eyeshadows and still others, are traditionally produced by pressing cosmetic powder into a solid tablet, and placing the tablet in a special container.

Containers divided into compartments for holding solid tablets of different types and colors of cosmetic powder are also known.

In addition, as shown in the Italian patent application No. 21352 A/87, dated 20 July 1987, the possibility is provided for placing together different types and colors of cosmetic powders inside the same container, using for such purpose, suitable means for the temporary division of the container into adjacent sectors which are subsequently filled with respective cosmetic powders, which are individually pressed. The above means for the temporary division of the container are then removed and the powders as a whole are subjected to a final pressing for compacting and surface uniforming.

At the end of the process, the surface of the multiple cosmetic product inside the container is smooth and perfectly horizontal.

SUMMARY OF THE INVENTION

An object of the invention is to obtain a process for the production of a cosmetic product with powders of several colors or different characteristics, whose surface may assume conformations other than those previously developed.

According to the invention, this object is attained by a process for the production of a cosmetic product with powders of several colors or different characteristics, characterized in that it comprises a succession of alternate stages of introduction of cosmetic powders and compression of the same for the formation of a pile of layers of powder, and a further stage of excavation of the pile of layers for the definition of at least one visible surface formed by adjacent portions of said superimposed layers.

In this way, by making an appropriate excavation, it is possible to obtain a surface with the desired shape, with a whole series of different colors.

BRIEF DESCRIPTION OF THE DRAWINGS

The features of the present invention shall be made more evident by some embodiments illustrated as a non-limiting example in the enclosed drawings, wherein:

FIGS. 22 to 29 illustrate a third process according to the invention for the production of a cosmetic product having adjacent strips of different colors with a smooth flat surface.

DETAILED DESCRIPTION OF THE PREFERRED EMBODIMENTS

Figure 1:
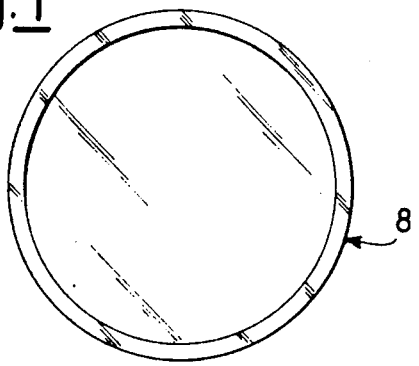
FIGS. 1 to 10 illustrate a first process according to the invention for the production of a cosmetic product having concentric colors with a concave surface.
Figure 6:
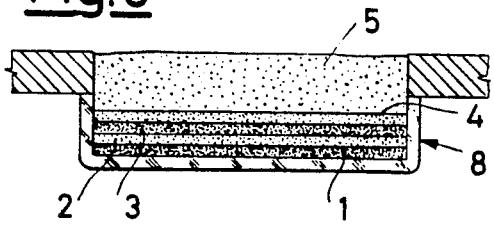
Figure 2:
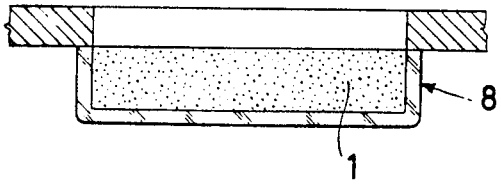
Figure 7:
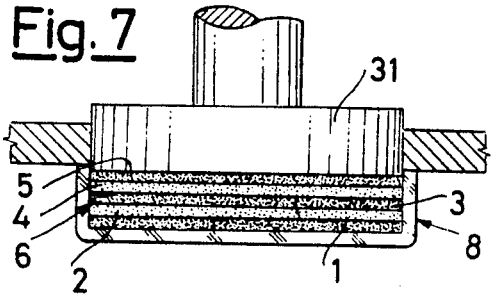
Figure 3:
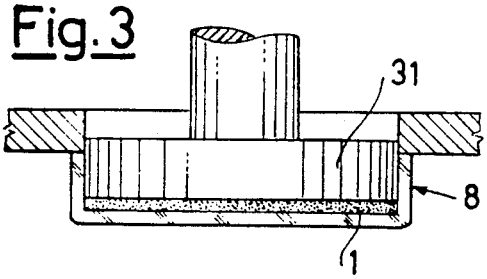
Figure 8:
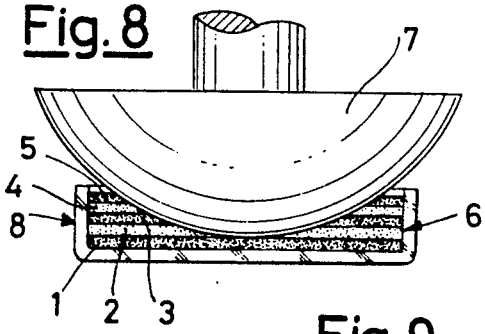
Figure 4:
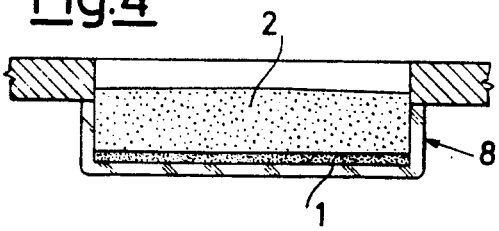
Figure 9:
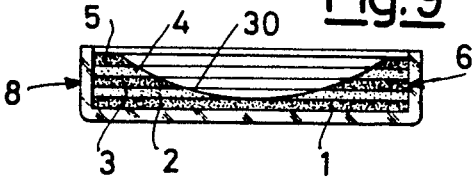
Figure 10:
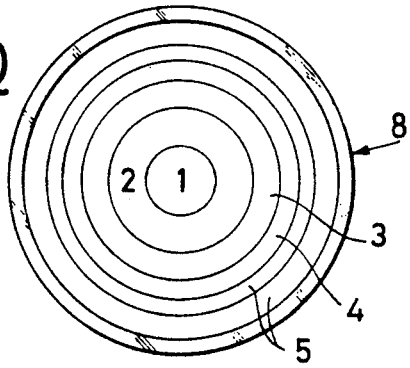
Figure 5:
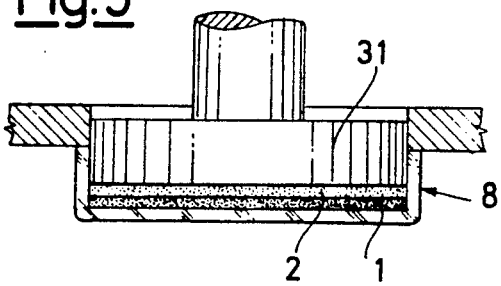

With reference to the above figures, FIG. 1 illustrates a plan view from above of a cylindrical container 8, suitable for being filled according to the process illustrated in FIGS. 2 to 8, which show the container in a diametrical cross-section. In particular, the process comprises alternate stages of loading (FIGS. 2, 4) of different powders 1, 2 inside the container 8 and of compression (FIGS. 3, 5) of the same towards the bottom of the container 8 by means of a piston 31 to create corresponding layers 1, 2. Such stages of loading of the powders 1, 2 and of compressing the same are alternated, in a similar manner, but not shown, for the superimposition of further layers of powder 3, 4 up to a last stage of loading a powder 5 inside the container 8 (FIG. 6) and of compression of the same powder 5 (FIG. 7) towards the bottom of the container 8. The cosmetic product thus obtained appears as a pile 6 of layers of powder. As illustrated in FIG. 8, such pile 6 is excavated by means of a fixture 7, such as for example a grinding tool applied to the chuck of a lathe or of a drill or a rotating cutting blade, so as to give the surface of the pile 6 a concave shape, indicated with 30 in FIG. 9, which allows the presentation to the sight of the user of a whole series of concentric annular rings corresponding to the different powder layers 1 to 5 having different color or characteristics according to the different production requirements. In FIG. 10, there is shown a plan view from above of the cosmetic product obtained with the first process.

Naturally, the process is easily extendable to the production of any cosmetic product having the shape of a square, rectangle, ellipse and so on, provided with a concavity of a corresponding and different shape located at the center or in more or less peripheral areas of the container.

Figure 11:
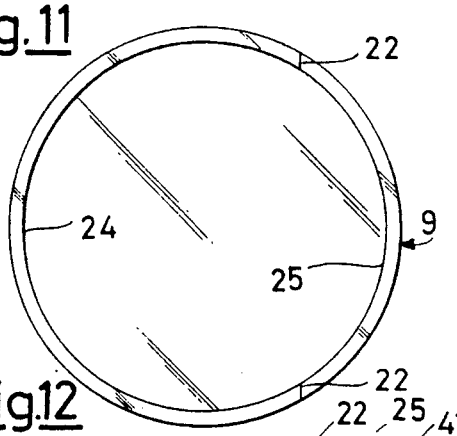
FIGS. 11 to 21 illustrate a second process according to the invention for the production of a cosmetic product having a shaped surface with adjacent portions of different colors, which rises upwardly in the shape of a pyramid with opposite sides of different dimensions.
Figure 12:
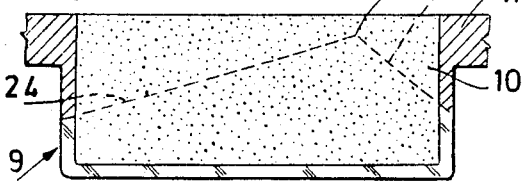
Figure 13:
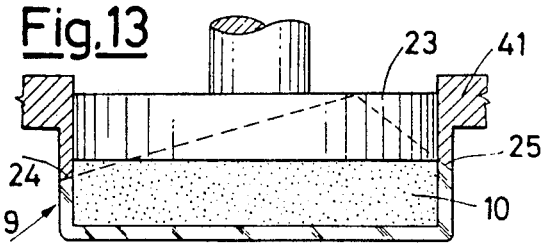
Figure 14:
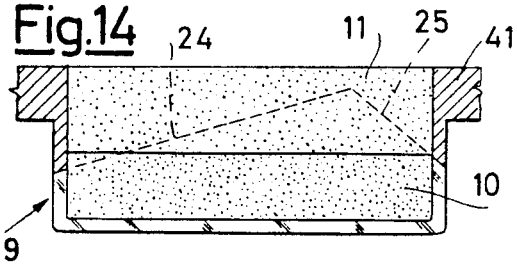
Figure 15:
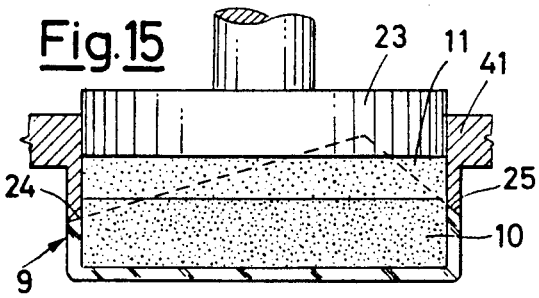
Figure 16:
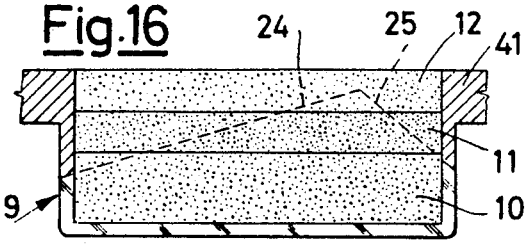
Figure 17:
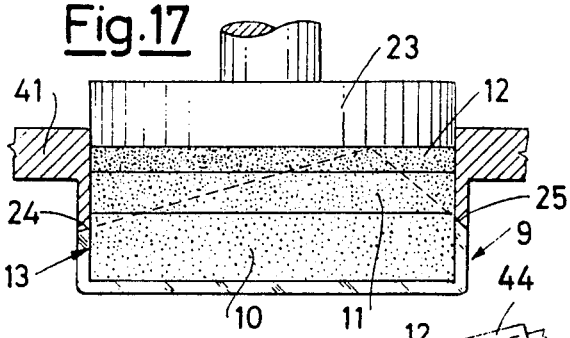
Figure 18:
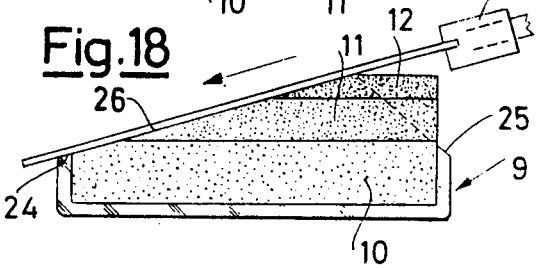
Figure 19:
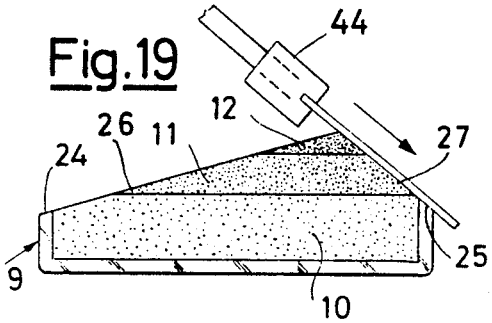
Figure 20:
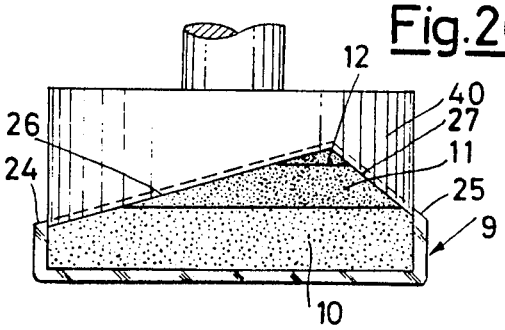
Figure 21:
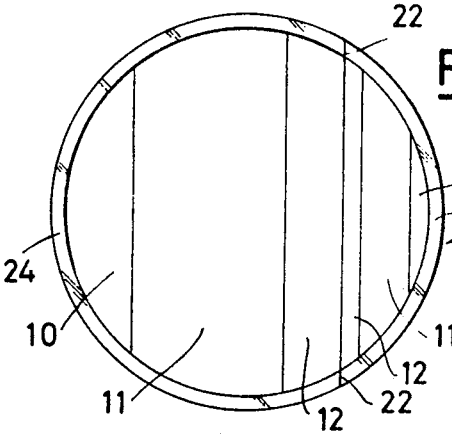

FIG. 11 illustrates a plan view from above of a container 9 previously cut along oblique planes 24, 25 convergent in a cusp 22 and suitable for being filled according to the process illustrated in FIGS. 12 to 19, which show the container 9 in a diametrical cross-section perpendicular to the cutting planes 25, 25 together with a dolly 41. In particular, the process comprises alternate stages of loading (FIGS. 12, 14, 16) of different powders 10, 11, 12 and of compression of the same towards the bottom of the container 9 with a piston 23 to create corresponding layers 10, 11, 12. As illustrated in FIG. 17, the product thus obtained appears like a pile 13. As illustrated in FIGS. 18, 19 by means of an implement 44, such as a cutting blade, the surface of the pile 13 is then shaped by operating a first oblique cut of the surface itself according to a plane 26, coincident with the corresponding cutting plane 24 of the container 9, as illustrated in FIG. 18, and a second oblique cut according to a plane 27, coincident with the other cutting plane 25 of the container 9, as illustrated in FIG. 19; there lastly comes into action a shaped pressing piston 40 (FIG. 20). At the end of the process the surface of the pile 13 is shaped as illustrated in FIG. 20 and has adjacent portions of different color or characteristics. Such surface rises upwards with opposite sides of different dimensions. FIG. 21 is a plan view from above of FIG. 20.

FIG. 22 illustrates a plan view from above of a temporary holding space 14 utilized with the process illustrated in FIGS. 23 to 28. In particular, the process comprises alternate stages of loading (FIGS. 23, 25) of different powders 15, 16 inside the space 14 (as shown in a vertical cross-sectional view in FIGS. 23 to 26) and of compression (FIGS. 24, 26) of the same towards a sliding bottom 18 of the space 14 with a piston 28 to create corresponding layers 15, 16. Such stages of loading of the powders 15, 16 and of compressing the same are alternated, in a similar manner, but not shown, for the superimposition of further layers of powder in any number. The cosmetic product thus obtained appears like a pile 19, which is extracted from the temporary space 14 and inserted into a final container 20, illustrated in FIG. 27, with the different layers arranged perpendicularly to the bottom of the container 20. With reference to the same FIG. 27, in a subsequent stage, the pile 19 is cut by means of a fixture 21, provided with a cutting blade 39. As illustrated in FIG. 28, a subsequent stage, the pile 19 is compacted with a piston 29. FIG. 29 illustrates the final cosmetic product seen from above, which has a succession of adjacent strips of different colors constituted by the same layers 15, 16 and so on previously superimposed and pressed.

I claim:

1. A process for the production of a cosmetic product having powders of several different characteristics, said process comprising the steps of:

introducing a first cosmetic powder into a container and compressing said first cosmetic powder;

introducing at least one additional cosmetic powder having a different characteristic than said first cosmetic powder into said container on top of said first cosmetic powder and compressing said at least one additional cosmetic powder to form a vertical pile having layers of said first cosmetic powder and said at least one additional cosmetic powder; and excavating said pile to form at least one visible surface having adjacent portions of said layers.

2. The process according to claim 1, wherein the step of excavation forms a concave surface having concentric annular rings corresponding to said layers.

3. The process according to claim 1, wherein said step of excavating comprises the step of cutting said pile obliquely to an axial extension of said pile for exposing adjacent portions of said layers.

4. The process according to claim 1, further comprising the steps of;

removing said pile from said container;

placing said pile in a second container in an orientation transverse to an orientation of said pile in said first container;

cutting said pile parallel to a longitudinal extension thereof; and compressing said pile in a direction perpendicular to said longitudinal extension.

* * * * *